US006960854B2

(12) United States Patent
Nadjafizadeh et al.

(10) Patent No.: US 6,960,854 B2
(45) Date of Patent: Nov. 1, 2005

(54) CENTRIFUGAL TURBINE FOR BREATHING-AID DEVICES

(75) Inventors: Hossein Nadjafizadeh, Villiers-les-Nancy (FR); Philippe Perine, Bouxieres Aux Dames (FR); Pascal Liegeois, Villiers-les-Nancy (FR)

(73) Assignee: Mallinckrodt Developpement France, Villiers-les-Nancy (FR)

( * ) Notice: Subject to any disclaimer, the term of this patent is extended or adjusted under 35 U.S.C. 154(b) by 0 days.

(21) Appl. No.: 10/496,876

(22) PCT Filed: Nov. 8, 2002

(86) PCT No.: PCT/FR02/03846

§ 371 (c)(1),
(2), (4) Date: Oct. 22, 2004

(87) PCT Pub. No.: WO03/046385

PCT Pub. Date: Jun. 5, 2003

(65) Prior Publication Data

US 2005/0036887 A1 Feb. 17, 2005

(30) Foreign Application Priority Data

Nov. 27, 2001 (FR) ..... 01 15314

(51) Int. Cl.[7] ..... H02K 5/04; H02K 5/12

(52) U.S. Cl. ..... 310/89; 310/58; 310/156.21; 417/423.1; 417/423.14; 417/424.1; 415/203

(58) Field of Search ..... 310/89, 58, 60 R, 310/62–63, 60 A, 156.08, 156.09, 156.12; 417/420, 423.1, 423.7, 423.14, 424.1; 415/182.1, 184, 186, 188, 203

(56) References Cited

U.S. PATENT DOCUMENTS

| | | | | | |
|---|---|---|---|---|---|
| 1,389,034 | A | * | 8/1921 | Dean | 310/156.09 |
| 3,243,621 | A | * | 3/1966 | Wesolowski | 310/168 |
| 3,246,187 | A | * | 4/1966 | Ienura | 310/156.21 |
| 4,428,719 | A | * | 1/1984 | Hayashibara et al. | 417/354 |
| 4,553,075 | A | * | 11/1985 | Brown et al. | 318/254 |
| 4,954,736 | A | * | 9/1990 | Kawamoto et al. | 310/156.21 |
| 5,407,331 | A | * | 4/1995 | Atsumi | 417/420 |
| 5,591,017 | A | * | 1/1997 | Dwyer | 417/366 |

* cited by examiner

*Primary Examiner*—Tran Nguyen
(74) *Attorney, Agent, or Firm*—Baker Botts LLP.

(57) ABSTRACT

The invention concerns an electric turbin (1) comprising a turbine rotor (4, 7), a turbine stator (2, 3), an electric motor member (5, 6) for driving the rotor (4, 7) in rotation relative to the stator (2, 3), and having the following features: the turbine stator (2, 3) comprises a stator body defining a compression chamber (12); the turbine rotor (4, 7) includes a plurality of blades (26, 27) integral with a shaft (4) mounted coaxially rotating in the body (2, 3) of the turbine stator; the electric motor member (5, 6) comprises a toroidal motor stator (6) housed in a motor housing (16, 23) of the turbine stator (2, 3), at the center of the toroidal compression chamber (12) and a motor rotor (5) mounted on the shaft (4) of the turbine rotor, axially opposite the motor stator (6).

13 Claims, 4 Drawing Sheets

CENTRIFUGAL TURBINE FOR BREATHING-AID DEVICES

RELATED APPLICATIONS

This is a U.S. national phase of PCT/FR02/03846 filed Nov. 8, 2002, claiming priority from FR 01/15314 filed Nov. 27, 2001.

BACKGROUND OF THE INVENTION

The invention concerns motorised turbines intended for the production of a continuous flow of air and more particularly the turbines equipping respiratory assistance devices.

These respiratory assistance devices can be provided for treating sleep apnoea disorders.

Patients suffering from these disorders are liable, during their sleeping time, to pass through phases of apnoea during which they stop breathing, thus causing them to wake up.

To remedy these disorders, there exist devices comprising a respiratory mask applied over the nose and/or mouth of a user while he is asleep, and a case supplying pressurised air to this mask so as to prevent the user entering an apnoea phase.

In order to supply the pressurised air to the respiratory mask, the known respiratory assistance devices generally propose to deliver a continuous flow, regulated or not, of air by means of a turbine driven rotationally by an electric motor. This air flow is conveyed by a tube into the mask which furthermore comprises a calibrated leakage aperture, the desired pressurisation thus being maintained.

For example, the patent FR 2 663 547 describes such a device.

This document refers to an installation for continuous supply of respiratory gas pressurisation comprising a respiratory mask with calibrated aperture and a pressurised gas supply unit connected by a tube to the mask.

Within the pressurised gas supply unit, a centrifugal type turbine operated by an electric motor is provided for generating a discharge of air.

These devices of the prior art have a drawback as regards their size.

This is because a respiratory assistance device is intended, the majority of the time, for use at home. It must therefore be easily transportable and not very bulky in order to be placed at the foot of the bed of the patient or on a bedside table.

Earlier devices, with the passing of time, have been made increasingly compact following technological development. Nevertheless, it would seem that a limit has currently been reached as regards respiratory assistance devices comprising a conventional arrangement of their elements, as described in the aforementioned patent.

This is due partly to the fact that the motor/turbine assembly occupies a large space in the pressurised gas supply unit through its two-part structure.

SUMMARY OF THE INVENTION

The aim of the invention is to overcome these drawbacks of the prior art by providing a more compact motor/turbine assembly, allowing the implementation of respiratory assistance devices of reduced size.

To that end, the object of the invention is an electric turbine comprising a turbine rotor, a turbine stator, an electric motor member intended to drive the rotor rotationally with respect to the stator, said turbine having the following characteristics:

- the turbine stator comprises a stator body defining a generally toric compression chamber provided with an annular opening;
- the turbine rotor comprises a set of blades extending generally radially from a central air inlet formed by an annular intake duct to the annular opening of the compression chamber of the turbine stator, this set of blades being fixed to a shaft mounted coaxially able to rotate in the turbine stator body;
- the electric motor member comprises a toric motor stator housed and fixed in a motor housing of the turbine stator, at the centre of the toric compression chamber, and a motor rotor mounted and fixed on the turbine rotor shaft, axially opposite the motor stator.

One out of the motor stator or rotor can be a permanent magnet, just as at least one out of the motor stator or rotor can be a toric winding.

Furthermore, the turbine rotor shaft can be mounted on at least one bearing coaxial with the annular intake duct, and on at least one bearing situated in the motor housing.

The stator body of the turbine can comprise two parts cooperating with one another and delimiting the toric compression chamber.

The blades can be carried by an overmoulded wheel forming a sleeve on the turbine rotor shaft, said sleeve possibly comprising a shoulder intended for the axial support of the motor rotor.

Said wheel carrying the blades can also be truncated cone-shaped.

These blades carried by the wheel can be formed from a flat wall fixed perpendicular to the surface of the wheel, this wall having a generally trapezoidal shape and having a greater height in the central part of the wheel than in its peripheral part.

Moreover, certain of said blades can comprise, in their part disposed in the central part of the wheel, a protruding tip intended to follow the shape of the annular intake duct.

In one embodiment, one blade out of two comprises such a protruding tip.

According to another embodiment, certain of said blades form an angle of 5 to 60 degrees with the radius of the wheel passing through the end of the blade, at the periphery of the wheel.

BRIEF DESCRIPTION OF THE DRAWINGS

Other particular features and advantages of the invention will emerge further in the following description relating to the accompanying drawings, given by way of a non-limiting example.

DETAILED DESCRIPTION OF THE INVENTION

Figure 1:
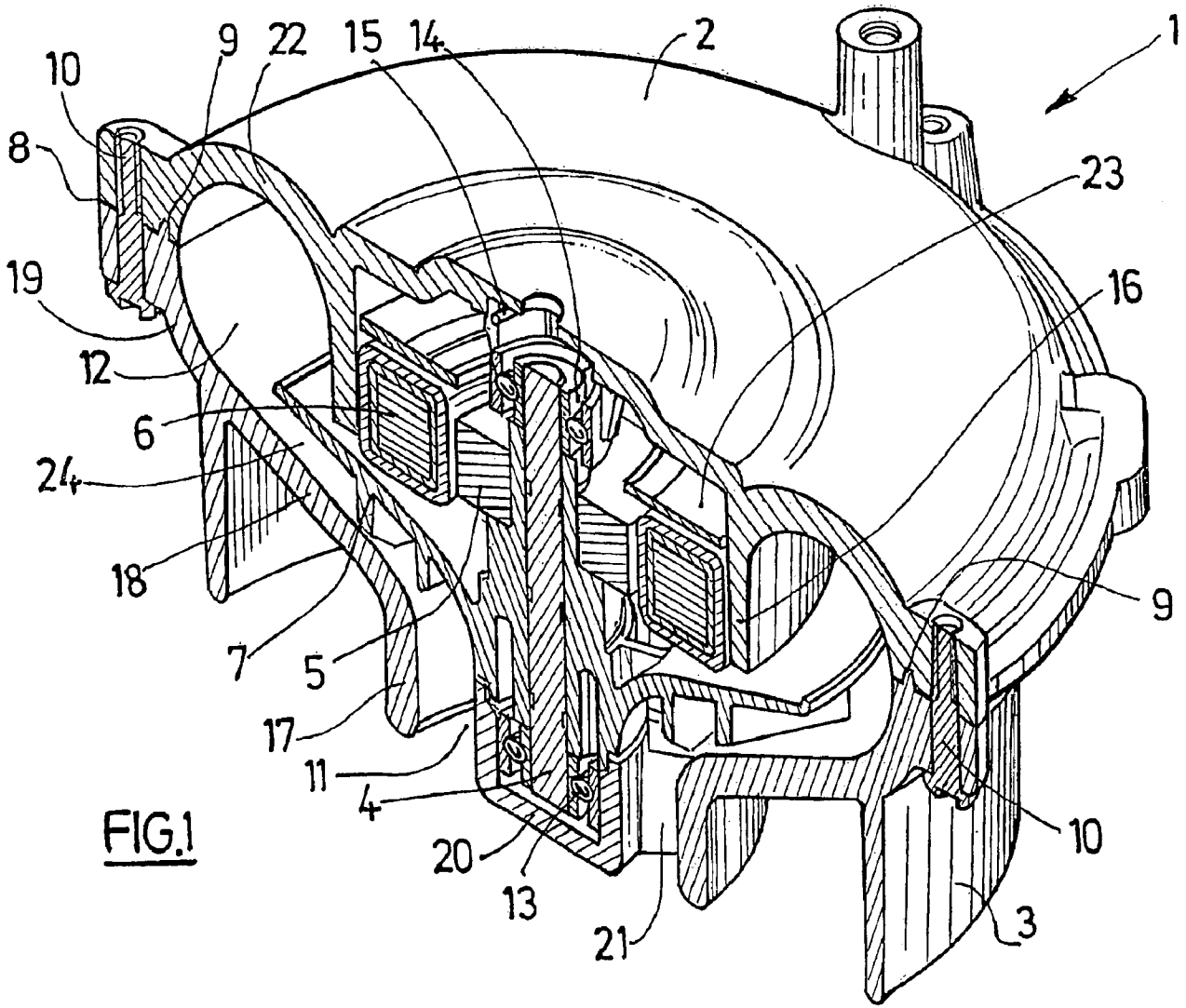
FIG. 1 is a perspective view, in diametral section, of a turbine according to the invention.
Figure 2:
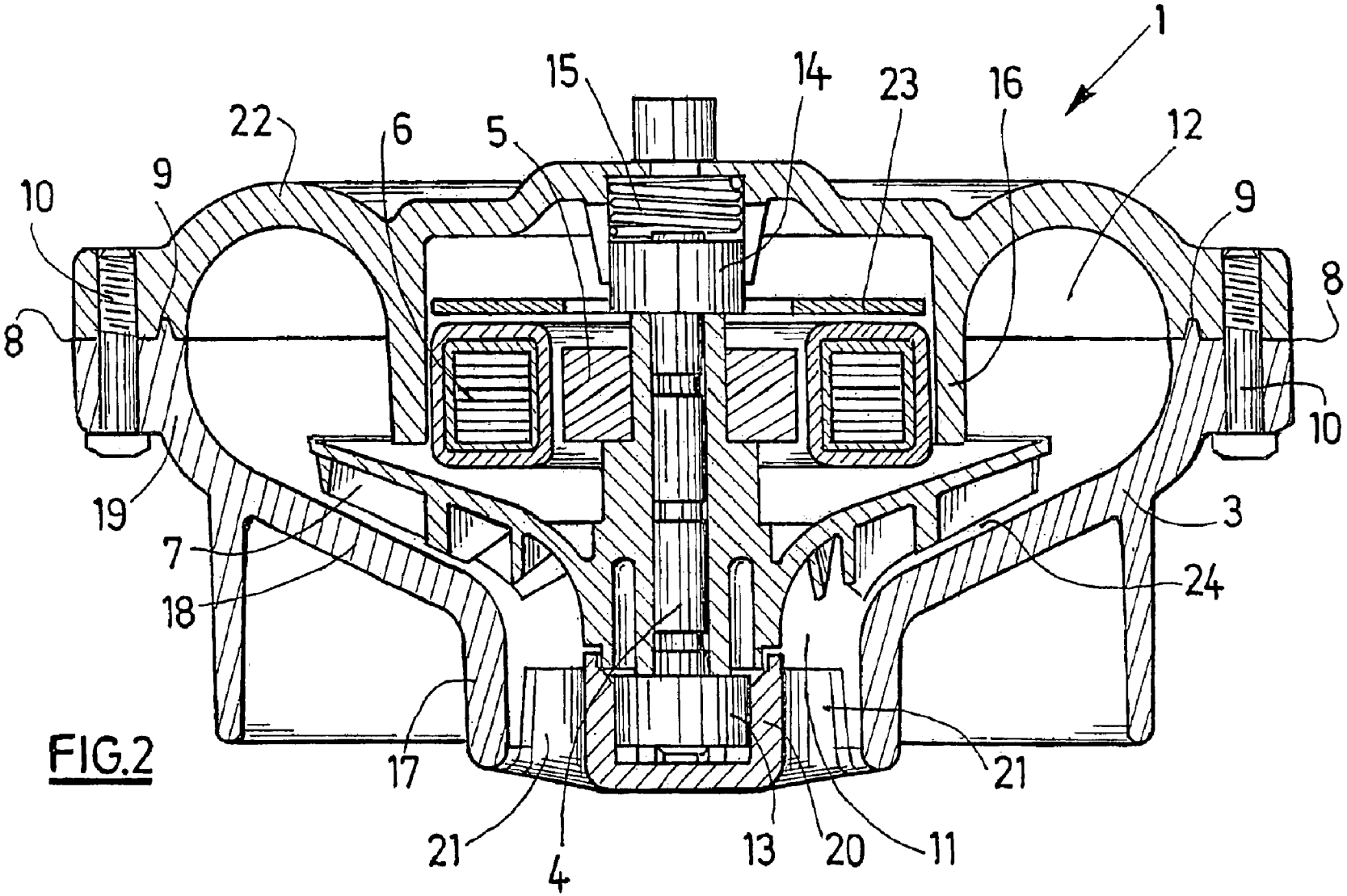
FIG. 2 is a front view, in diametral section, of the turbine of FIG. 1.
Figure 3:
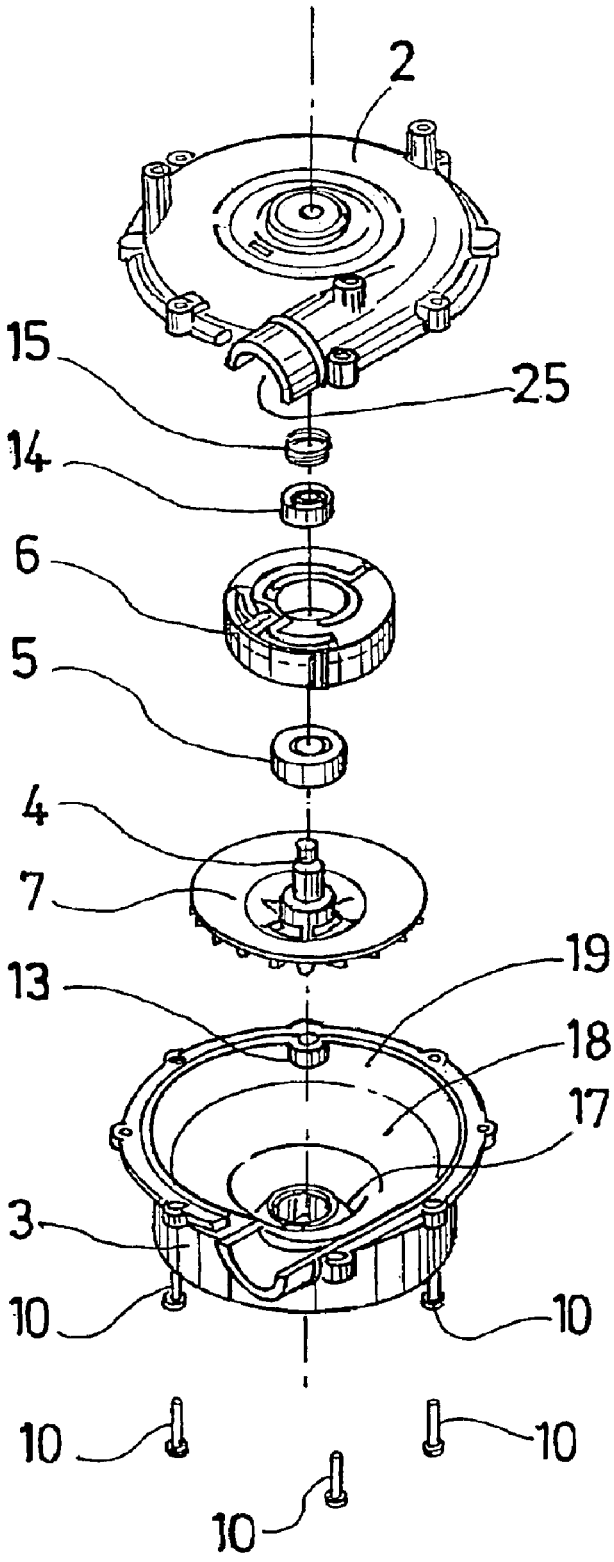
FIG. 3 is an exploded view of the turbine of FIG. 1.
Figures 4, 5:
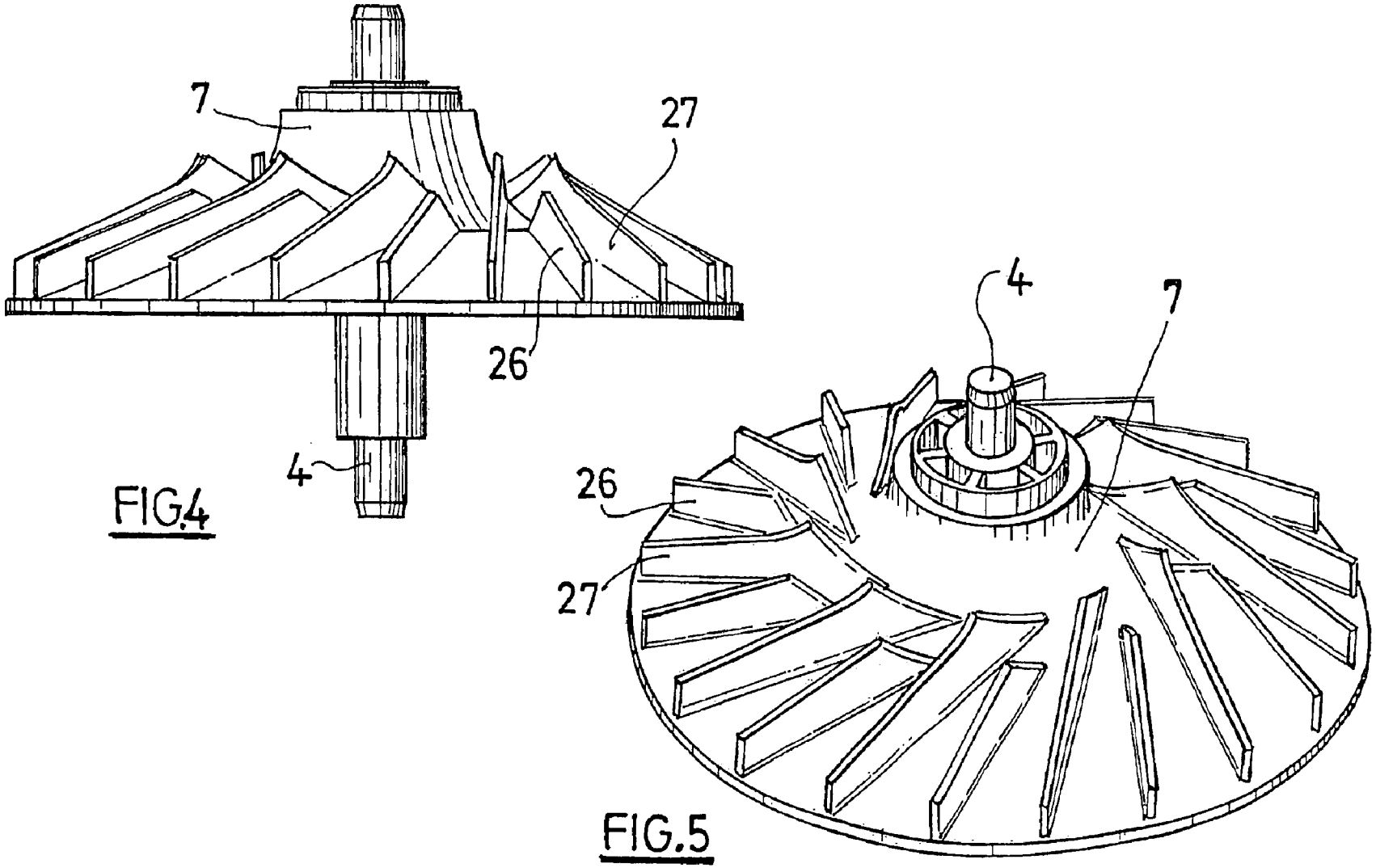
FIG. 4 is a side view of the wheel of the turbine of FIG. 1.
FIG. 5 is a perspective view of the wheel of FIG. 4.

In the following description, the terms upper, lower, above, below, vertical and horizontal refer to the turbine in the position in which it is depicted in FIGS. 1 to 3.

The turbine 1 depicted in FIGS. 1, 2 and 3 comprises an upper body 2 assembled with a lower body 3, defining between them a volume in which there are positioned a vertical shaft 4 mounted on two roller bearings 13, 14, a toric magnet 5, a toric coil 6 and a blade-carrying wheel 7.

The upper body 2 is dish-shaped, comprising an internal annular skirt 16 (on the side of the lower body 3) coaxial with said dish and intended to form a motor housing, and a semi-toric wall 22 situated on the periphery of the dish.

The lower body 3 has a hollow shape delimited by a first annular wall 17 connected to a second conical wall 18 widening out towards the top and itself connected to a connecting wall 19 with an arc of a circle cross-section.

The annular wall 17 surrounds a hub 20 intended for mounting the roller bearing 13, said hub 20 being positioned in a rigid manner coaxially with the annular wall 17 by three fixed blades 21 connecting the inside of the annular wall to the outside of the hub and disposed at 120° to one another.

The upper 2 and lower 3 bodies are formed in order to constitute, once assembled, an internal volume characteristic of a centrifugal turbine; in particular, the walls 19, 22 of the upper 2 and lower 3 bodies delimit a toric compression chamber 12.

This chamber 12 is open to the outside by means of a substantially cylindrical tangential duct 25 (towards the mask of the user) whose longitudinal axis is horizontal.

The assembly of the upper 2 and lower 3 bodies is implemented in a sealed manner at a joint face 8. Studs 9 emerging from the lower body 3 at the joint face 8 are arranged in order to enter corresponding apertures formed in the upper body 2, thus providing the stringent positioning of one body with respect to the other. The holding of the assembly is implemented by means of a series of screws 10 disposed regularly on the perimeter of the joint face.

As mentioned previously, the lower body 3 comprises a hub 20 placed coaxially inside the annular wall 17 and fitted so that a first roller bearing 13 intended to support the vertical shaft 4 fits therein in order to be rigidly fixed therein.

Similarly, the upper body 2 comprises a similar housing delimited by the skirt 16 and intended to receive a second roller bearing 14 supporting the vertical shaft 4 but, unlike the housing provided for the first roller bearing 13, this housing is fitted in order to immobilise the second roller bearing 14 in its radial directions and to leave it free as regards translational motion in the vertical direction.

A spring 15 is provided inside the housing of the second roller bearing 14 and exerts a force between the latter and the upper body 2 so as to maintain a pressure downwards on the roller bearing 14.

The vertical shaft 4, on the ends of which the two roller bearings 13, 14 are mounted, is therefore positioned between the upper 2 and lower 3 bodies so as to be coaxial with the annular intake duct 11 and the toric compression chamber 12 formed by the assembly of the upper 2 and lower 3 bodies.

The blade-carrying wheel 7 is also mounted on the vertical shaft 4 so as to be driven rotationally therewith. It can be for example overmoulded, glued or force-fitted on the shaft 4.

In the implementation presented, the blade-carrying wheel 7 has a substantially conical shape allowing it to follow the internal shape of the annular 17 and conical 18 walls of the lower body 3, the blades being disposed on the wheel 7 so as to drive the air in order to make it circulate between the volume delimited by said annular wall 17 and the toric compression chamber 12, during the rotation of the vertical shaft 4.

Furthermore, the annular skirt 16 receives a horizontal plate 23 rigidly fixed to its internal wall, these two elements delimiting the previously described motor housing.

The motor housing is intended to receive the toric coil 6 and keep it fixed with respect to said body 2.

This housing is disposed so that the coil 6, when it is in place by gluing or fitting, is positioned as follows:

- as regards positioning in the vertical direction: between the upper roller bearing 14 of the vertical shaft 4 and the blade-carrying wheel 7;
- as regards positioning in the horizontal plane: the coil 6 coaxially surrounds the vertical shaft 4.

The vertical shaft 7 also carries the toric magnet 5 rigidly fixed and positioned as follows:

- as regards positioning in the vertical direction: substantially facing the coil 6, surrounded thereby;
- as regards positioning in the horizontal plane: the toric magnet coaxially surrounds the vertical shaft 4.

The toric magnet 5 can be directly fitted tight or glued on the vertical shaft 4 or else, as depicted in FIGS. 1 to 3, the blade-carrying wheel 7 can be fitted tight or be glued on said shaft 4 by encasing it, the magnet 5 then being fitted tight or glued on this casing.

When the vertical shaft 4, the coil 6 and the magnet 5 are in place in the volume formed by the assembled upper 2 and lower 3 bodies, these three elements are coaxial and the shaft 4 is capable of a rotation on its longitudinal axis, when the magnet 5 is rotated with respect to the coil 6.

The volume defined by the upper 2 and lower 3 bodies and by the wheel 7 comprises an annular intake duct 11 open to the outside, coaxial with the vertical shaft 4 and delimited by the inside of the annular wall 17 and the external wall of the hub 20.

This annular intake duct 11 communicates over its entire circumference with a compression duct 24 delimited by the inside of the conical wall 18 and the face of the blade-carrying wheel 7. This compression duct 24 is therefore a truncated cone-shaped volume delimited by two coaxial cones widening out from the intake duct 11.

The compression duct 24 is itself connected over its entire circumference to the aforementioned toric compression chamber 12.

This toric compression chamber 12 is delimited by the wall 22 and the annular projection of the upper body 2, and by the wall 19 of the lower body 3, these elements being arranged in order to constitute a toric internal volume comprising a circular slot forming an annular opening allowing communication with the compression duct 24.

When the wheel 7 is mounted in the turbine 1, the blades 26, 27 act on the air mainly at the level of the compression duct 24 and also partly at the level of the annular intake duct 11.

This is because the wheel 7 carries two types of blade 26, 27.

A first type of blade 26 is formed from a flat wall fixed perpendicular to the surface of the wheel, this wall having a generally trapezoidal shape and having a greater height in the central part of the wheel 7 than in its peripheral part.

A second type of blade 27 is similar to the first type 26 but is longer so as to go further into the central part of the wheel 7. Moreover, the part of the blade disposed in this central part of the wheel 7 has a protruding tip intended to follow the shape of the junction between the intake duct 11 and the compression duct 24.

These two types of blade are furthermore disposed so as to form an angle of 5 to 60 degrees with the radius of the wheel 7 passing through the end of the blade, at the periphery of the wheel 7, each type of blade possibly being disposed with a different angle from the other type.

What is claimed is:

1. An electric turbine (1) comprising a turbine rotor (4, 7), a turbine stator (2, 3), and electric motor member (5, 6) intended to drive the rotor (4, 7) rotationally with respect to the stator (2, 3), wherein the turbine stator (2, 3) comprises a stator body defining a generally toric compression chamber (12) provided with an annular opening;

the turbine rotor (4, 7) comprises a set of blades (26, 27) extending generally radially from a central air inlet formed by an annular intake duct (11) to the annular opening of the compression chamber (12) of the turbine stator (2, 3), this set of blades (26, 27) being fixed to a shaft (4) mounted coaxially able to rotate in the turbine stator body;

the electric motor member (5, 6) comprises a toric motor stator (6) housed and fixed in a motor housing (16, 23) of the turbine stator (2, 3), at the centre of the toric compression chamber (12), and a motor rotor (5) mounted and fixed on the turbine rotor shaft (4), axially opposite the motor stator (6).

2. A turbine according to claim 1, characterised in that one out of the motor stator (6) or rotor (5) is a permanent magnet.

3. A turbine according to claim 1, characterised in that at least one out of the motor stator (6) or rotor (5) is or are a toric winding.

4. A turbine according to claim 1, characterised in that the turbine rotor shaft (4) is mounted on at least one bearing (13, 20) coaxial with the annular intake duct (11).

5. A turbine according to claim 1, characterised in that the turbine rotor shaft (4) is mounted on at least one bearing (14) situated in the motor housing.

6. A turbine according to claim 1, characterised in that the stator body (2, 3) comprises two parts cooperating with one another and delimiting the toric compression chamber (12).

7. A turbine according to claim 1, characterised in that the blades (26, 27) are carried by an overmoulded wheel (7) forming a sleeve on the turbine rotor shaft (4).

8. A turbine according to claim 7, characterised in that said sleeve comprises a shoulder intended for the axial support of the motor rotor (5).

9. A turbine according to claim 1, characterised in that the blades (26, 27) are carried by a truncated cone-shaped wheel (7).

10. A turbine according to claim 9, characterised in that the blades (26, 27) are formed from a flat wall fixed perpendicular to the surface of the wheel (7), this wall having a generally trapezoidal shape and having a greater height in the central part of the wheel (7) than in its peripheral part.

11. A turbine according to claim 10, characterised in that at least certain (27) of said blades (26, 27) comprise, in their part disposed in the central part of the wheel, a protruding tip intended to follow the shape of the annular intake duct (11).

12. A turbine according to claim 11, characterised in that one blade out of two comprise, in their part disposed in the central part of the wheel (7), a protruding tip intended to follow the shape of the annular intake duct (11).

13. A turbine according to claim 9, characterised in that certain of said blades (26, 27) form an angle of 5 to 60 degrees with the radius of the wheel (7) passing through the end of the blade, at the periphery of the wheel (7).

* * * * *

UNITED STATES PATENT AND TRADEMARK OFFICE

CERTIFICATE OF CORRECTION

PATENT NO. : 6,960,854 B2
APPLICATION NO. : 10/496876
DATED : November 1, 2005
INVENTOR(S) : Nadjafizadeh et al.

It is certified that error appears in the above-identified patent and that said Letters Patent is hereby corrected as shown below:

IN THE CLAIMS: Please replace Claims 1-13 with the following amended claims:

Col. 5 lines 5-24 should read

1. An electric turbine ~~(1)~~ comprising a turbine rotor ~~(4, 7)~~, a turbine stator ~~(2, 3)~~, and electric motor member ~~(5, 6)~~ intended to drive the rotor ~~(4, 7)~~ rotationally with respect to the stator ~~(2, 3)~~, wherein the turbine stator ~~(2, 3)~~ comprises a stator body defining a generally toric compression chamber ~~(12)~~ provided with an annular opening; the turbine rotor ~~(4, 7)~~ comprises a set of blades ~~(26, 27)~~ extending generally radially from a central air inlet formed by an annular intake duct ~~(11)~~ to the annular opening of the compression chamber ~~(12)~~ of the turbine stator ~~(2, 3)~~, this set of blades ~~(26, 27)~~ being fixed to a shaft ~~(4)~~ mounted coaxially able to rotate in the turbine stator body; the electric motor member ~~(5, 6)~~ comprises a toric motor stator ~~(6)~~ housed and fixed in a motor housing ~~(16, 23)~~ of the turbine stator ~~(2, 3)~~, at the centre of the toric compression chamber ~~(12)~~, and a motor rotor ~~(5)~~ mounted and fixed on the turbine rotor shaft ~~(4)~~, axially opposite the motor stator ~~(6)~~.

Col. 5 lines 25-26 should read

2. A turbine according to claim 1, characterised in that one out of the motor stator ~~(6)~~ or rotor ~~(5)~~ is a permanent magnet.

Col. 5 lines 27-29 should read

3. A turbine according to claim 1, characterised in that at least one out of the motor stator ~~(6)~~ or rotor ~~(5)~~ is or are a toric winding.

Col. 5 lines 30-32 should read

4. A turbine according to claim 1, characterised in that the turbine rotor shaft ~~(4)~~ is mounted on at least one bearing ~~(13, 20)~~ coaxial with the annular intake duct ~~(11)~~.

Col. 5 lines 33-35 should read

5. A turbine according to claim 1, characterised is that the turbine rotor shaft ~~(4)~~ is mounted on at least one bearing ~~(14)~~ situated in the motor housing.

Col. 6 lines 1-3 should read

6. A turbine according to claim 1, characterised in that the stator body ~~(2, 3)~~ comprises two parts cooperating with one another and delimiting the toric compression chamber ~~(12)~~.

UNITED STATES PATENT AND TRADEMARK OFFICE

CERTIFICATE OF CORRECTION

PATENT NO. : 6,960,854 B2
APPLICATION NO. : 10/496876
DATED : November 1, 2005
INVENTOR(S) : Nadjafizadeh et al.

It is certified that error appears in the above-identified patent and that said Letters Patent is hereby corrected as shown below:

Col. 6 lines 4-6 should read
7. A turbine according to claim 1, characterised in that the blades ~~(26, 27)~~ are carried by an overmoulded wheel ~~(7)~~ forming a sleeve on the turbine rotor shaft ~~(4)~~.

Col. 6 lines 7-9 should read
8. A turbine according to claim 7, characterised in that said sleeve comprises a shoulder intended for the axial support of the motor rotor ~~(5)~~.

Col. 6 lines 10-13 should read
9. A turbine according to claim 1, characterised in that the blades ~~(26, 27)~~ are carried by a truncated cone-shaped wheel ~~(7)~~.

Col. 6 lines 14-19 should read
10. A turbine according to claim 9, characterised in that the blades ~~(26, 27)~~ are formed from a flat wall fixed perpendicular to the surface of the wheel ~~(7)~~, this wall having a generally trapezoidal shape and having a greater height in the central part of the wheel ~~(7)~~ than in its peripheral part.

Col. 6 lines 20-24 should read
11. A turbine according to claim 10, characterised in that at least certain ~~(27)~~ of said blades ~~(26, 27)~~ comprise, in their part disposed in the central of the wheel, a protruding tip intended to follow the shape of the annular intake duct ~~(11)~~.

Col. 6 lines 25-29 should read
12. A turbine according to claim 11, characterised in that one blade out of two comprise, in their part disposed in the central part of the wheel ~~(7)~~, a protruding tip intended to follow the shape of the annular intake duct ~~(11)~~.

UNITED STATES PATENT AND TRADEMARK OFFICE

CERTIFICATE OF CORRECTION

PATENT NO. : 6,960,854 B2
APPLICATION NO. : 10/496876
DATED : November 1, 2005
INVENTOR(S) : Nadjafizadeh et al.

It is certified that error appears in the above-identified patent and that said Letters Patent is hereby corrected as shown below:

Col. 6 lines 30-33 should read

13. A turbine according to claim 9, characterised in that certain of said blades ~~(26, 27)~~ form an angle of 5 to 60 degrees with the radius of the wheel ~~(7)~~ passing through the end of the blade, at the periphery of the wheel ~~(7)~~.

Signed and Sealed this

Tenth Day of June, 2008

JON W. DUDAS
*Director of the United States Patent and Trademark Office*